United States Patent [19]

Stolk

[11] Patent Number: 4,641,797

[45] Date of Patent: Feb. 10, 1987

[54] HOT AIR BALLOON KITE

[76] Inventor: Richard D. Stolk, 259 Braeshire Dr., Manchester, Mo. 63011

[21] Appl. No.: 606,866

[22] Filed: May 3, 1984

[51] Int. Cl.[4] ..... B64C 31/06

[52] U.S. Cl. ..... 244/153 R

[58] Field of Search ..... 244/153 R, 155 A, 152, 244/154, 155 R; D21/88

[56] References Cited

U.S. PATENT DOCUMENTS

| | | | |
|---|---|---|---|
| D. 6,961 | 10/1873 | Simons | D21/88 |
| 698,634 | 4/1902 | Conyne | 244/153 R |
| 757,012 | 4/1904 | Bell | 244/153 R |
| 919,436 | 4/1909 | Jackson | 244/153 R |
| 1,009,274 | 11/1911 | Ayling | 244/153 R |
| 1,016,180 | 1/1912 | Seydel | 244/153 R |
| 1,222,791 | 4/1917 | Perkins | 244/153 R |
| 1,529,076 | 3/1925 | Marchessault | 244/153 R |
| 2,134,282 | 10/1938 | Irvin | 244/153 R |
| 2,693,330 | 11/1954 | Green | 244/153 R |
| 2,699,307 | 1/1955 | Corbin | 244/153 R |
| 3,073,556 | 1/1963 | Smokowski | 244/153 |
| 3,599,909 | 8/1971 | Young | 244/153 R |
| 3,796,399 | 3/1974 | Wechsler | 244/153 R |
| 3,806,071 | 4/1974 | Brown | 244/153 R |
| 3,860,204 | 1/1975 | Checkley | 244/153 R |
| 3,861,626 | 1/1975 | Hufstader | 244/153 R |
| 4,389,032 | 6/1983 | Meckley | 244/153 R |

FOREIGN PATENT DOCUMENTS

| | | | |
|---|---|---|---|
| 23493 | 10/1906 | United Kingdom | 244/153 R |
| 261877 | 12/1926 | United Kingdom | 244/153 R |

OTHER PUBLICATIONS

L. Hunt, "25 Kites That Fly", 1929, pp. 31–34, Dover Publications, Inc. N. York, republished in 1971.

*Primary Examiner*—Galen Barefoot

*Attorney, Agent, or Firm*—John F. Rohe

[57] ABSTRACT

A hot air balloon silhouette shaped kite is disclosed herein. Means for decorating the kite, allowing a convex configuration for high wind conditions, and for progressively venting wind through the kite are shown in preferred embodiments of the invention.

10 Claims, 13 Drawing Figures

HOT AIR BALLOON KITE

PRIOR ART STATEMENT FOR HOT AIR BALLOON KITE

Lightweight material for fabricating kites, and lightweight rigid and semi-rigid members forming a structural framework for kites are well known to the art. The technology of kites has not yet disclosed a suitable means of permitting a simulated image of a hot air balloon, as claimed in the subject invention.

TECHNICAL FIELD

This invention relates to an improved kite having a body of lightweight material the outline of which resembles the silhouette of an inflated hot air balloon. Multiple cells having a triangular shape of varying size may be combined on the surface of the kite in differing patterns.

BACKGROUND OF THE INVENTION

Hot air ballooning has recently become a popular recreational activity although the technology has been known for over two hundred years. Likewise kite flying has recently regained popularity, perhaps because of the new materials available for construction. These two activities have not yet successfully merged until now. This invention relates to kites and more particularily to kites resembling an inflated hot air balloon shape.

The obvious approach of making a two stick kite in the shape of a hot air balloon was found to lack sufficient flying stability without a long tail assembly. However incorporation of a long tail has the shortcoming of detracting from the overall image of the kite as the silhouette of a hot air balloon. This difficulty in design has been overcome in the present invention.

In today's climate of numerous kite shapes including the popular deltas, parafoils, and snowflakes, no one has been successful in developing a hot air balloon shaped kite which is considered flightworthy and can lend itself to reproduction using efficient manufacturing methods.

SUMMARY OF THE INVENTION

The present invention is of a kite having a hot air balloon silhouette shape with a vented cover and with a drogue. The drogue enhances the hot air balloon image by substituting the function of a kite tail. One design consists of one or more cells having symmetry about the vertical centerline. The cells may also be asymetric around the kite's horizontal centerline. The upper cell geometry of a two cell kite need not be identical in geometric shape, size, or weight with the lower cell. Symmetry must however be maintained on both sides of the kite's vertical centerline.

An object of the invention is to provide a kite having a variety of surface adornments consisting of one or more cells attached to the covering surface. The cells not only enhance stability, but also facilitate the three dimensional image which resembles a hot air balloon. A feature of the invention resides in the means of providing flying stability without using a long tail by incorporating a symetrical vent in the kite's main body.

A further object of the invention is found in the use of a plurality of cells of varying size positioned above or below a vent joined together by cell longerons. The longerons are connected via a plurality of bridle lines or vertical keels through a common towing ring attached to a central bridle line. The bridle lines are designed to be adjustable for varying wind conditions. The kite's orientation in relation to the wind can expediently be modified by use of a single knot adjustment on the central bridle line.

A further object of the invention is found in the use of various geometric drogues which may be suspended via a swivel connection from the kite body to complete the hot air balloon silhouette image. It was discovered that a drogue may provide added stability in high wind conditions.

Stability may also be achieved by creating a convex surface shape of the cover. A taut bow line secured to opposite sides of the outer perimeter of the cover will yield a convex cover shape.

A further object of the invention is to use a tapered vent opening which narrows from the center toward the perimeter of the cover. This allows greater freedom of designs to be used in conjunction with the cover. A closure may be added across the vent opening partially restricting wind from passing through the cover. By varying the air restriction one may add for lift and broaden the range of wind conditions in which the kite can be flown.

The ease in assembly of the multiple cells to the cover is enhanced by constructing the cover from two or more segments of material joined at the horizontal spar pocket location. This significantly reduces the amount of fabric one must use.

BRIEF DESCRIPTION OF THE DRAWINGS

The present invention will become more readily apparent from the following detailed description of the accompanying drawings in which.

DETAILED DESCRIPTION OF THE DRAWINGS

With the many components to be identified in the description, it will be helpful to establish a number of definitions to be used throughout. The "cover" (20) is a light-weight, flexible, wind resistant material providing the wind receiving plane which is attached to a framework consisting principally of horizontal and vertical members. A "longeron" (28, 70–74, 91–94) will be any vertical member acting as a mast to support the cover (20) or cells (30–35). A "spar" (38, 40, 42) is a horizontal support member for the cover which absorbs pressure on its ends in the direction of its axis. "Leading" (30) and "trailing" (31) refer to the relative positions of cells relative to the location of the "vent" (25). "Apex edge" (29) refers to the edge of the triangular cell (30–35) farthest removed from the cover (20) to which the "bridle lines" (88) are fastened to connect all cells to a common "towing ring" (90).

Figure 1:
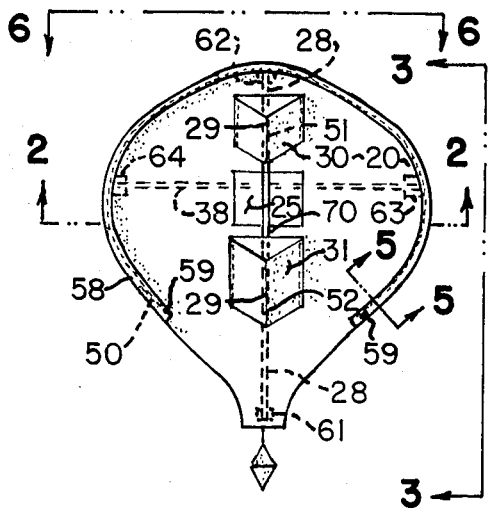
FIG. 1 is a front view of the present invention.

The basic elements of the kite construction consist of a cover (20), having a vent (25), symmetrically positioned about a vertical centerline defined by a rigid vertical cover longeron (28) as shown in FIG. 1. The vertical cover longeron (28) is fastened to the backside of the cover (20) at both ends by means of cover pockets (61) and (62). The cover pockets (61) and (62) are but one means to secure the vertical cover longeron (28) to the cover (20) as used in today's manufacture of kites.

A horizontal cover spar (38) is positioned perpendicular to the vertical cover longeron (28) and is secured at each end via cover pockets (63) and (64) as shown in FIG. 1. A semi-rigid member (50) is used to maintain a taut cover (20) over at least the upper half of the kite framework. A perimeter sleeve (58) is fastened to the cover (20) by means such as stitching with sufficient space inside to allow the semi-rigid member (50) to be slipped inside from a slit (59) in the stitching at either or both ends of the perimeter sleeve (58). Alternatively, a single slit (59) may be usd to insert two or more semi-rigid members (50) from the leading edge of the cover (20) as shown in more detail in partial sections with FIG. 6, and as explained subsequently in this Specification.

Continuing with FIG. 1, a leading triangular cell (30) is positioned symmetrically with the vertical cover longeron (28) axis above the vent (25) with its rear edges fastened to the cover (20). The leading triangular cell (30) is positioned so that the apex edge (29) of the triangle projects to the axis of the vertical cover longeron (28). A trailing triangular cell (31) is positioned symmetrically with the vertical cover longeron (28) axis below the vent (25). The rear edges of the trailing triangular cell (31) are fastened to the cover (20) in the same manner as the leading triangular cell (30).

Apex longeron sleeves (51) and (52) are formed in the apex edge (29) of the leading and trailing triangular cells (30) and (31) respectively so as to hold an apex cell longeron (70) in place. The apex cell longeron (70) is aligned parallel to the vertical cover longeron (28). The ends of the apex longeron sleeves (51) and (52) are stitched shut prior to insertion of the apex cell longeron (70). Consequently the apex cell longeron (70) should be composed of a material possessing a flexible property to allow bending without breaking when inserted into the open end of the apex longeron sleeves (51) and (52).

Figure 3:
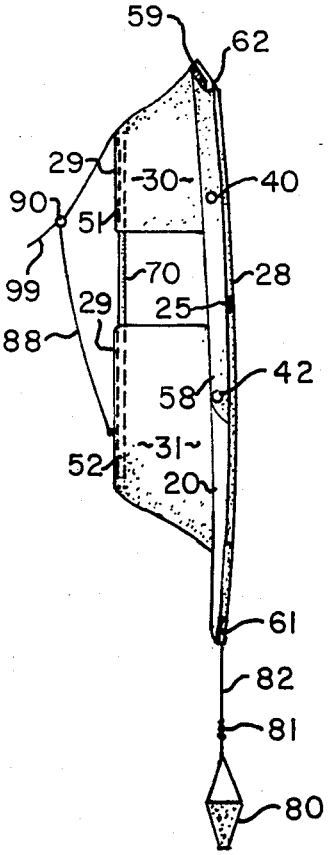
FIG. 3 is a side elevation of a two cell vented kite in partial section according to the principles of the present invention, shown along 3—3 of FIG. 1.
Figure 2:
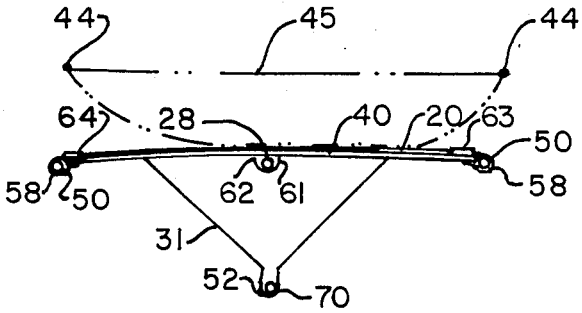
FIG. 2 is a top view of the present invention with a taut bowstring, along 2—2 of FIG. 1.

FIG. 2 shows a sectional top view of a two cell balloon shaped kite with a taut bowstring (45). FIG. 3 shows a side elevation of a balloon with both leading and trailing triangular cells aligned in the same geometric planes. In order to reduce overall weight of the kite, the material which forms the cover (20) may be reduced in thickness behind the cells (30) and (31) without affecting the strength of the cover (20). In addition maintaining one layer of material allows more ambient light to penetrate the cover (20) which in turn illuminates the particular color more effectively than with several layers of material. Bowstring tabs (44) and one or more bowstrings (45) may be added across the back of the kite for high wind flying capabilities. A taut bowstring (45) increases stability by causing the cover (20) to have a convex windward surface plane as shown in FIG. 2.

Figure 4:
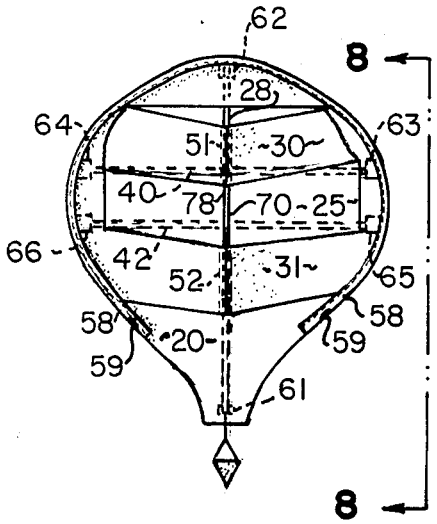
FIG. 4 is a front view in partial section of a two cell vented kite showing cell surfaces extending to the edge of the cover as described in the present invention.

FIGS. 3 and 4 show a leading and trailing horizontal cover spar (40) and (42), respectively, positioned above and below the vent (25). This is distinguished from the single horizontal cover spar (38) as described in FIG. 1. The dual horizontal cover spars (40) and (42) not only improve the appearance, but also are functionally superior in that they maintain the cover (20) in a taut condition. The decision to employ two rather than one horizontal cover spars is determined by the relative size of the leading and trailing triangular cells (30) and (31) as well as the size of the kite itself.

FIG. 4 shows a front view of a two cell balloon shaped kite in which the leading triangular cell (30) and trailing triangular cell (31) have been elongated to span the entire width of the cover (20) while maintaining symmetry about the vertical cover longeron (28). The leading horizontal cover spar (40) is secured at each end via cover pockets (63) and (64) or other suitable means. Likewise the trailing horizontal cover spar (42) is secured by cover pockets (65) and (66).

Figure 5:
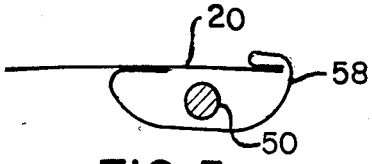
FIG. 5 is a fragmental cross sectional view of the edge of the cover and framework of the present invention.

Common with all designs described, the shape of the outer perimeter of the kite is maintained by using a semi-rigid member (50) having flexible characteristics so that it may be inserted into the perimeter sleeve (58) without breaking, yet possessing sufficient stiffness to assist in maintaining a taut cover (20). Details regarding the perimeter sleeve (58) attachment to the cover (20) is shown in FIG. 5. Sufficient space is retained in the perimeter sleeve (58) so that two semi-rigid members (50) may pass or overlap each other. The perimeter sleeve (58) may be fastened to either the front or back of the cover (20). By using a contrasting color of the perimeter sleeve (58) and the cover (20) an attractive design can be achieved when the perimeter sleeve (58) is fastened on the front side of the cover (20).

Figure 6:
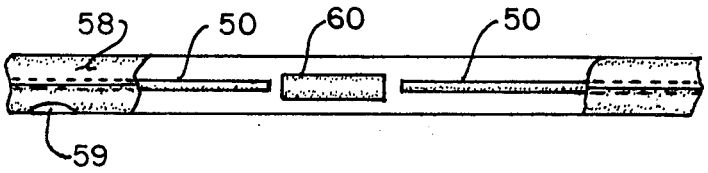
FIG. 6 is a top view in partial section which shows the construction of a multipiece semi-rigid member inside a sleeve secured at the outer perimeter of the cover described in the present invention, shown along 6—6 of FIG. 1.

An alternate means of inserting the semi-rigid member (50) inside the perimeter sleeve (58) is shown in FIG. 6 which is a cross sectional view of the perimeter sleeve (58). A hollow connector (60), shown in FIG. 6, having an inner diameter of mating size with the outer diameter of the semi-rigid member (50) is chosen as a means of joining several sections of the semi-rigid member (50) together. A slit (59) of about the same length as the diameter of connector (60) is used to insert the semi-rigid members into the perimeter sleeve (58).

Figure 7:
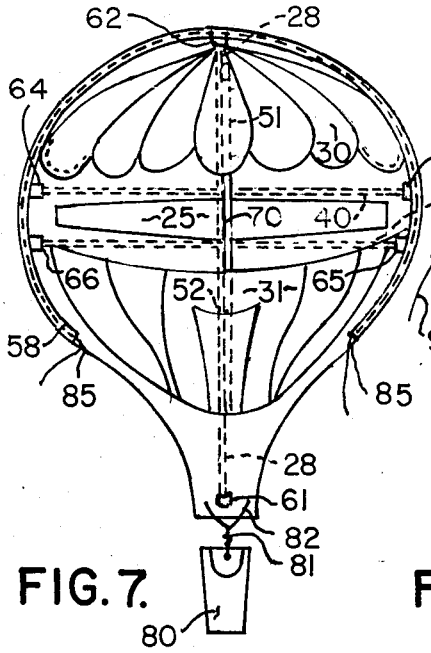
FIG. 7 is a front view of a decorated two cell vented kite.

A decorated two cell vented kite as described above is shown in FIG. 7 in a frontal view. The leading triangular cell (30) is fashioned from multiple pieces of fabric to obtain a decorative design. It was discovered that the size, shape, and even the weight of the trailing triangular cell (31) need not be the same as the leading triangular cell (30) provided vertical symmetry is maintained on both sides of the cover longeron (28). Vertical symmetry of vent (25) must be maintained on both sides of the cover longeron (28).

A drogue (80) preferably having the geometric shape of a cylinder or truncated cone may be suspended beneath the trailing edge of the cover (20) by means of a swivel (81) and one or more cords (82). Other surface adornments such as ribbons (85) may be added to the kite to enhance the overall attractiveness of the kite.

Figure 8:
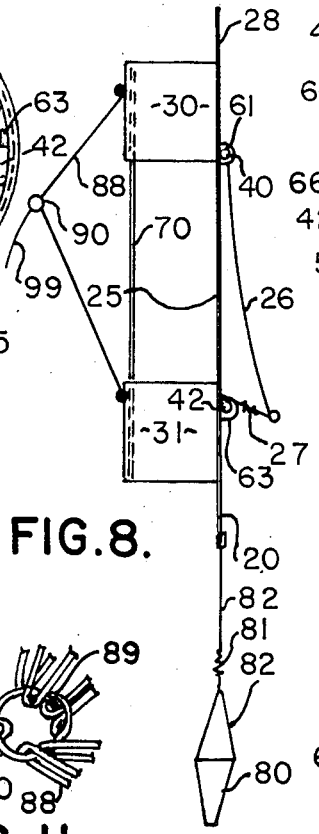
FIG. 8 is a side view of a kite and vent closure as described in the present invention, shown along 8—8 of FIG. 4.

A refinement of the vent (25) in the cover (20) is shown in FIG. 8. This side view of a two cell vented kite shows the vent (25) partially covered with material forming a vent closure (26). The vent closure (26) is fastened to the cover (20) along the leading edge of the vent (25) by means of stitching. The corners of the trailing edge of the vent closure (26) are attached to the trailing edge of the vent (25) by using an elastic, spring, or other means to limit the travel of the vent closure (26) from the cover (20). The use of an elastic device (27) allows the vent (25) opening to become a function of increasing or decreasing wind conditions.

Figure 9:
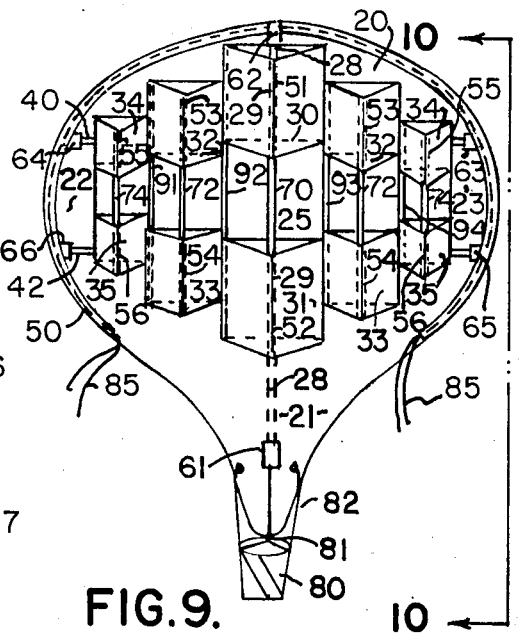
FIG. 9 is a front view of a multicelled vented kite as described in the present invention.

FIG. 9 shows the front view of a ten cell design in which a plurality of leading triangular cells (30, 32 and 34) and trailing triangular cells (31, 33 and 35) of diminishing size are positioned above and below the vent (25). The rear surfaces of the cells are attached to the cover (20) by stitching or other suitable means. The apex edges (29) of the cells are joined across the vent (25) by means of apex cell longerons (70, 72 and 74) which are fastened to the cells (30, 31, 32, 33, 34 and 35) using apex longeron sleeves (51, 52, 53, 54, 55 and 56). The vent (25) is situated between the leading horizontal cover spar (40) and the trailing horizontal cover spar (42).

When a multicelled kite is made having large dimensions, the cover (20) may need additional support to maintain a relatively flat surface. This may be provided by adding multiple cell longerons (91, 92, 93 and 94) extending vertically through the rear edges of the leading and trailing pairs of triangular cells (30, 31, 32, 33, 34 and 35) adjoining the cover (20) as shown in FIG. 9. The vertical cover longeron (28) and horizontal cover spars (40) and (42) are attached to the cover (20) via cover pockets (61,62, 63, 64, 65 and 66) as described previously in FIG. 4. A drogue (80) may be attached via cords (82) through a swivel (81) to the lower portion of the cover (20).

Figure 10:
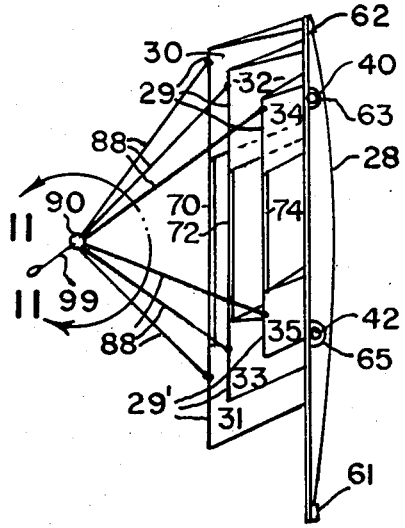
FIG. 10 is a side elevation of a multicelled vented kite as described in the present invention, shown along 10—10 of FIG. 9, also with bridle lines and towing ring.

FIG. 10 shows a side elevation of a ten cell vented kite having multiple bridle lines (88) which extend from the apex edge (29) of the leading triangular cells (30, 32 and 34) of diminishing size to the apex edge (29') of the trailing triangular cells (31, 33 and 35) of diminishing size passing through a common towing ring (90) which is connected to the kite line (99). All other parts of the construction of the kite shown in FIG. 10 have been described previously.

Figure 11:
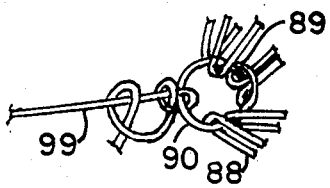
FIG. 11 is a perspective view of a means of positioning the towing ring to the central bridle line.

FIG. 11 shows the detail of joining the bridle lines (88) with a towing ring (90) which is tied to the kite line (99). One knot (89) is used on the center bridle line (88) connecting the leading and trailing triangular cells (30 and 31) together at the towing ring (90). This provides a means of temporarily positioning the ring (90) to a designated point on the bridle lines (88). The position may be changed to allow a variety of wind to kite angles thereby accommodating differing wind conditions by simply adjusting knot (89). All other bridle lines pass through the ring without a knot thereby allowing the lines to self-adjust with the center knotted (89) bridle line (88).

Figure 12:
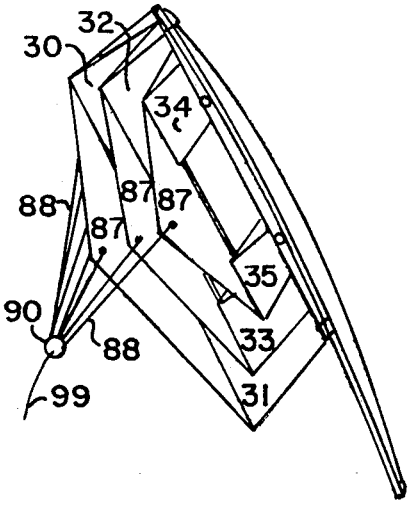
FIG. 12 is a side elevation of keels connected to pairs of triangular cells as described in this invention.

FIG. 12 shows the side elevation of a multiple cell kite using a plurality of keels (87) to which bridle lines (88) are connected prior to joining the towing ring (90). All other parts of the construction have been described previously.

Figure 13:
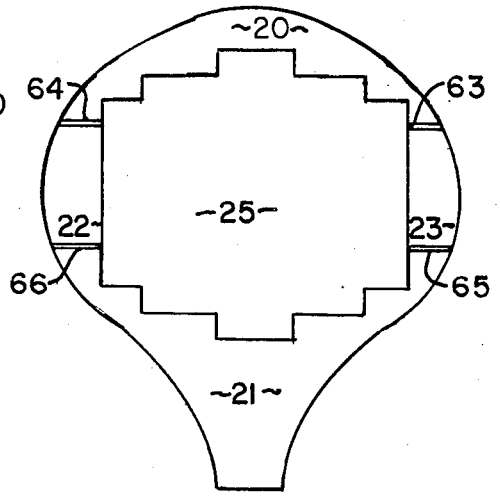
FIG. 13 is a front view of the present invention which shows the construction of the cover from segments of fabric.

FIG. 13 shows the cover (20) composed of a plurality of segments (20, 21, 22 and 23) of material. This design allows for the plurality of horizontal pockets (63, 64, 65 and 66) to be formed from the adjoining edges of the cover segments (20, 21, 22 and 23). This provides a practical means of making it possible for the cover (20) to be multicolored without compromising the lightweight character of cover (20).

Various shaped covers have been evaluated to simulate a hot air balloon shaped silhouette. These shapes are generally described by an aspect ratio computed by dividing the width of the kite at its widest part by its length or height of the framework. It has been discovered that the cover may be designed having an aspect ratio from 0.50 to 1.50 with the preferred ratio of 0.65 to 1.10 to maintain the desired balloon silhouette and still insure spirited flight characteristics.

It is to be understood that various modifications may be made from the specific details described, without departing from the spirit and scope of the invention.

What is claimed is:

1. A kite comprising:

a. a flat balloon silhouette-shaped cover having a vent, b. a plurality of vertical cover longerons, c. a plurality of horizontal cover spars, d. a semi-rigid member around the leading perimeter edge of the cover, e. a plurality of leading triangular cells, of diminishing size proceeding from vertical center line horizontally toward the edge, positioned symmetrically about the vertical center line of the cover, each cell having its rear surface on the cover, and its apex edge parallel to the cover, f. a plurality of trailing triangular cells, of diminishing size proceeding from the vertical center line horizontally toward the edge, positioned symmetrically about the vertical center line of the cover, each cell having its rear surface on the cover, and its apex edge parallel to the cover, and g. a plurality of cell longerons attached to the apex edges of any leading and trailing triangular cells which are in the same planes.

2. The kite described in claim 1 also comprising a vent closure affixed to the vent with an elastic device thereby allowing the vent closure to open proportionally with increasing wind conditions.

3. The kite described in claim 1 werein the vent height narrows from the vertical center line of the cover toward the side of the cover.

4. The kite described in claim 1 also comprising a drogue suspended from the lower portion of the cover.

5. The kite described in claim 1 also comprising a plurality of bowstrings fastened to opposite sides of the cover perimeter to permit a convex cover surface for high wind conditions.

6. The kite described in claim 1 also comprising a plurality of bridle lines which extend from the apex edges of the leading triangular cells to the apex edges of the trailing triangular cells through a common towing ring.

7. The kite described in claim 1 also comprising a means of temporarily positioning the towing ring to a designated point on the center bridle line.

8. The kite described in claim 1 also comprising a plurality of vertically positioned keels connecting pairs of leading and trailing cells to which the bridle lines are connected before joining at a common towing ring.

9. The kite described in claim 1 wherein the cover is composed of two or more segments of material joined at the horizontal spar pocket locations on the cover with pockets formed from the overlapping edges of the segments.

10. The kite described in claim 1 having an aspect ratio from 0.50 to 1.50.

* * * * *